United States Patent [19]

Miida

[11] 4,392,534

[45] Jul. 12, 1983

[54] COMPOSITE NOZZLE FOR EARTH BORING AND BORE ENLARGING BITS

[75] Inventor: Eishiro Miida, Ichikawa, Japan

[73] Assignee: Tsukamoto Seiki Co., Ltd., Tokyo, Japan

[21] Appl. No.: 292,183

[22] Filed: Aug. 12, 1981

[30] Foreign Application Priority Data

Aug. 23, 1980 [JP] Japan ..... 55/119692[U]
Dec. 25, 1980 [JP] Japan ..... 55/182902

[51] Int. Cl.[3] ..... E21B 10/18

[52] U.S. Cl. ..... 175/340; 175/393; 175/422

[58] Field of Search ..... 175/340, 393, 422; 166/398, 222, 223; 239/591, 600, 602

[56] References Cited

U.S. PATENT DOCUMENTS

| | | | |
|---|---|---|---|
| 2,950,090 | 8/1960 | Swart | 175/340 |
| 3,084,751 | 4/1963 | Scarborough | 175/340 |
| 3,129,777 | 4/1964 | Haspert | 175/340 |
| 3,189,107 | 6/1965 | Galle | 175/393 |
| 3,419,220 | 12/1968 | Goodwin et al. | 175/340 |
| 4,019,593 | 4/1976 | Craig | 175/340 |

FOREIGN PATENT DOCUMENTS

| | | | |
|---|---|---|---|
| 763676 | 1/1955 | United Kingdom | 175/340 |

*Primary Examiner*—Stephen J. Novosad
*Assistant Examiner*—Joseph Falk
*Attorney, Agent, or Firm*—Wenderoth, Lind & Ponack

[57] ABSTRACT

A composite nozzle for a drill bit and a bore enlarging bit, the body of the nozzle, which is adapted to discharge water toward rotary cutters, being fabricated from a ceramic. The nozzle has a bottom surface which is provided with a high-impact metal plate, and a circumferential wall portion also provided with a reinforcing plate.

1 Claim, 6 Drawing Figures

COMPOSITE NOZZLE FOR EARTH BORING AND BORE ENLARGING BITS

BACKGROUND OF THE INVENTION

This invention relates to a drill bit composite nozzle, for the circulation and ejection of drilling mud, installed in the water discharge passage of a bit for drilling or enlarging oil wells and the like. Conventional nozzles are composed of material which is resistant to wear, such as tungsten carbide, sintered carbide or a ceramic material. Such nozzles made of these types of material are relatively brittle, as well as being very expensive, except those made from ceramic material. This invention provides a tough and economical nozzle for the drill bit.

SUMMARY OF THE INVENTION

This invention relates to improvements in a composite nozzle. According to a feature of the invention, the nozzle is made of a ceramic material, and a reinforcing metal plate (and wall) is employed on the impact-receiving surface of the nozzle. This precludes damage to the nozzle resulting from the impact applied by rock fragments in the drilling mud when the drilling mud is circulated in the earth bore. In addition, the bottom surface and side walls of the composite nozzle are protected against damage during mounting of the nozzle in the drilling mud discharge passage and during handling, and loss of the nozzle due to wear and corrosion is prevented.

Various methods have been adopted to extract petroleum resources from deep within the earth. The most widely used of these is a rotary well drilling method that employs a drilling stem having a bit attached at one end thereof for boring down through rock strata in order to drill a well that extends down to the petroleum deposits underlying said strata.

To enhance well drilling efficiency a bit best suited for the particular geological features is employed as a matter of course. Other drilling techniques are equally important. Over-heating caused by frictional heat at the bit and cutter portions can be prevented by jetting drilling mud, of an appropriate viscosity and colloidal property, against the cutter tip of the bit as the bit is being subjected to a large drilling load. The compound nozzle which receives the violent ejection pressure exerted by mud, water and petroleum when drilling through subterranean water and petroleum veins, using the drilling mud as a strongly ejected dispersive medium in pumping up the fragments and lumps of rock pulverized by the bit cutter, needs to be protected.

Another important requirement is to prevent damage to the impact-receiving undersurface of the composite nozzle and to its thin, fragile upper side walls when the nozzle is being mounted in the water discharge passage of the bit, when the nozzle is being handled, and during the circulation of the drilling mud.

The present invention, by providing an improvement in a composite nozzle that is mounted in a passage for jetting drilling mud water toward the end portion of a drill bit, makes it possible to enhance well drilling efficiency. This is accomplished by replacing the heretofore employed metal carbide nozzle with a composite nozzle made of a ceramic material, and fixing a metal reinforcing plate to the impact-receiving surface of the composite nozzle, and, depending upon the type of bit, by using a reinforcing metal ring which is fixed intimately to the outer periphery of the composite nozzle in order to preclude damage to the thin wall portions of the nozzle as well. This arrangement enhances the impact resistance of the composite nozzle, prevents a decline in the flow velocity of the ejected drilling mud that might otherwise be caused by deposits attaching themselves to the nozzle interior, and precludes abrasion due to dispersed mud particles as well as corrosion caused by water and by emulsifying agents added to form a colloid of mud. Fixing the reinforcing metal ring to the bottom surface of the composite nozzle and, when necessary, to the outer periphery of the nozzle, prevents the lower, impact-receiving surface and the thin wall portion of the nozzle, mounted in the water discharge passage, from experiencing damage inflicted during handling or by pebbles contained in the discharging drilling mud.

While there is no particular restriction upon the materials that can be employed to fabricate the ceramic composite nozzle, a material which is hard and substantially non-brittle is suitable in view of the various environmental conditions that the nozzle will experience during use. Accordingly, in the most preferred arrangement, a high-impact metal reinforcing plate is fixed to the impact-receiving surface of a hard porcelain or microcrystalline glass or similar material. A microcrystalline glass recently developed and sold by Corning Glass Company, U.S.A., is particularly well-suited for application to the present invention since the glass can be cut.

Since the bottom surface of the composite nozzle within the water discharge passage is exposed to intense impact and the upper wall portion of the nozzle is thin, and in order to prevent damage inflicted by rock particles contained in the drilling mud, the metal plate is fixed to the bottom surface of the composite nozzle and a reinforcing metal ring is fit around the nozzle and fixed securely thereto. This prevents nozzle damage and prolongs nozzle life.

BRIEF EXPLANATION OF THE ACCOMPANYING DRAWINGS

Embodiments of the present invention will be described in conjunction with various experiments and with reference to the accompanying drawings in which.

DETAILED DESCRIPTION OF THE PREFERRED EMBODIMENT

Figure 1:
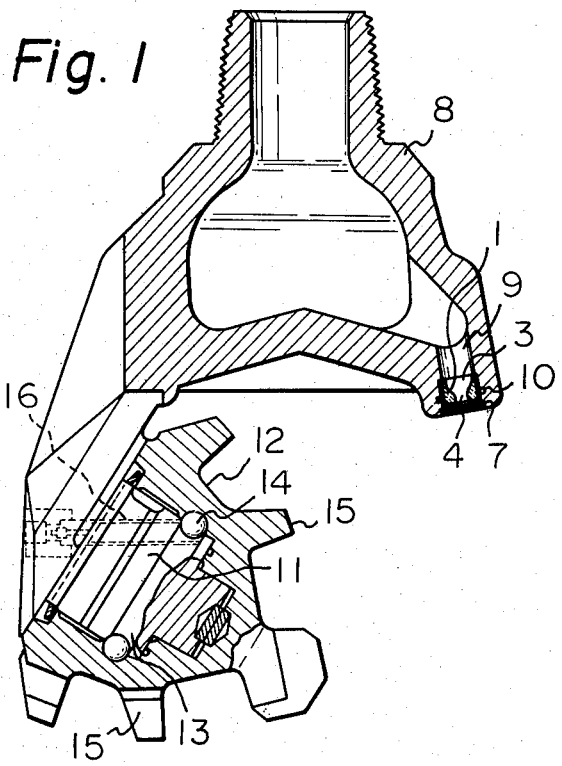
FIG. 1 is a longitudinal sectional view showing a portion of a bit in which a composite nozzle in accordance with the present invention has been installed.

Referring first to FIG. 1, a drill bit body 8 has water discharge passages 9, only one of which is shown, bored into the lower end thereof along the circumference of the drill bit body, and a plurality of cutters 12 provided at the bottom of the body, only one cutter being shown. The water discharge passages 9, which are approximately the same in number as the cutters 12, are bored so as to confront teeth 15 provided on the cutters. The body of a ceramic composite nozzle 1 according to the invention is fitted into the end portion of the water discharge passage 9 and is retained in position by an O-ring that presses against the nozzle wall and by a ring 7 the outer circumference of which fits into an annular groove formed in the lower part of the water discharge passage 9, the ring 7 exhibiting both toughness and rigidity. To drill a well the bit body 8 is rotated as it proceeds through the earth. This causes rotation of the cutter 12 which is mounted, through balls 14, on a journal leg 11 extending downwardly and inwardly from the lower end of the bit body 8. As the teeth 15 on the rotating cutter 12 bore through the earth formations, water is ejected into the excavated cavity from the mouth 4 of the composite nozzle 1 so that drilling may proceed while the water washes off soil and rock fragments from between adjacent teeth 15.

The balls 14 are fit into an annular groove 13 formed in the journal leg 11, and into an annular recess formed in the cutter 12. This arrangement allows the cutter 12 to rotate smoothly on the journal leg and prevents the cutter from slipping off the journal leg. A lubricating passage 16 supplies the base portion of the journal leg 11 and the fitting portion of the cutter 12 with a lubricant.

Figure 2:
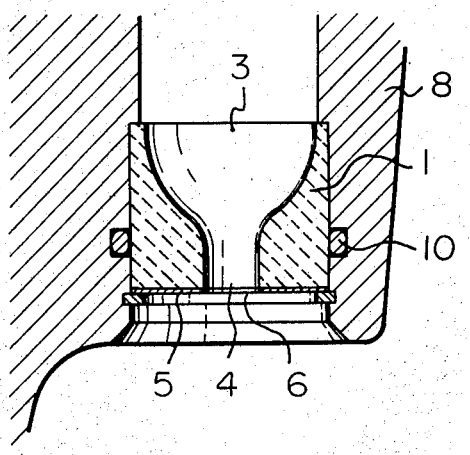
FIG. 2 is an enlarged longitudinal sectional view showing a portion of the installed nozzle of a first embodiment of the invention.
Figure 3:
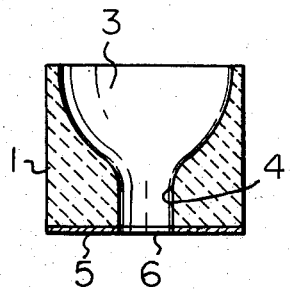
FIG. 3 is a longitudinal sectional view of the nozzle itself.

In FIGS. 2 and 3, the water discharge passage 9 is shown provided in a water discharging protuberance provided on the drill bit body 8 between adjacent journal legs 11. The composite nozzle 1, which has a throat 3 the upper portion of which is flared, is inserted into the lower part of the water discharge passage 9 so that the portion of the nozzle having the flared throat extends upwardly into the passage. In this case the O-ring 10 is inserted beforehand into the annular groove formed in the inner wall of the water discharge passage 9. A reinforcing metal plate 5 having a central aperture 6 is bonded beforehand to the lower surface of the ceramic composite nozzle 1 by means of a bonding agent such as epoxy resin.

Figure 4:
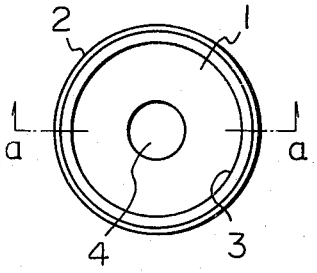
FIG. 4 is a plan view of the nozzle.

In the plan view of FIG. 4, the inventive ceramic composite nozzle 1 of the first embodiment is shown to have a nearly funnel-shape, with the mouth 4 having its upper portion flared, as described above, and its lower portion narrowed to form the mouth 4.

Figure 5:
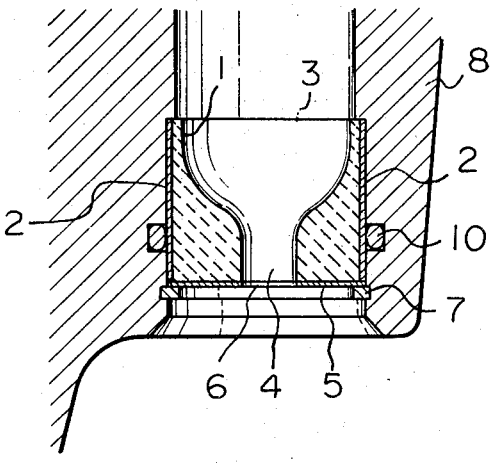
FIG. 5 is an enlarged longitudinal sectional view showing the installed nozzle of a second embodiment of the invention.
Figure 6:
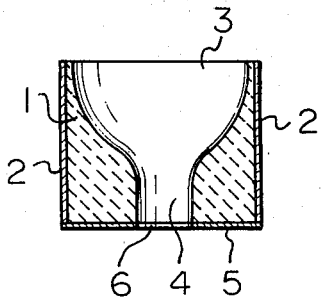
FIG. 6 is a longitudinal sectional view of the nozzle itself according to the second embodiment of the invention.

In the second embodiment of the inventive ceramic composite nozzle as depicted in FIGS. 5 and 6, a reinforcing metal ring 2 is provided and bonded to the outer periphery of the nozzle, in addition to the reinforcing metal plate 5 which is bonded to the bottom of the nozzle-reinforcing ring combination.

The ceramic composite nozzle of the present invention was subjected to the following experiments:

EXPERIMENT 1

Underground rock formations consisting of arenaceous rock masses were drilled using an oil well drilling bit of the type shown in FIG. 1, the drilling bit having a water discharge nozzle comprising a ceramic nozzle and a reinforcing metal plate bonded to the impact-receiving surface of the ceramic nozzle. For comparison, a similar drill bit (comparative example 1) having a carbide nozzle was employed at the same time to drill through the same ground formations, the purpose being to determine the influence of the different nozzle materials on the excavated cavity, and to compare the results.

The test conditions and results are as shown in the Table. It should be noted that the ceramic nozzle was inspected following withdrawal from the shaft and was found to be free of wear and corrosion. The results in the Table concerning drilling performance in terms of drilled depth show that the ceramic nozzle arrangement is considerably superior for equal drilling periods. These results clearly reveal that the inventive nozzle is superior to the prior-art nozzle in terms of durability and drilling performance.

TABLE

| | |
|---|---|
| Bit size | 8½" × 10 |
| Nozzle size | 20 mm × 3 mm (shaft diameter) |
| Drilling period | 50 hours |
| Bit load | 10–14 t. |
| Bit speed | 70 rpm |
| Drilling mud and water conditions and specific gravity | 1.80 NaCl 4000 ppm, pH 9.4, earth and sand content: 0.5% |
| Drilled depth | Present invention: 210 m<br>Comparative example: 195 m |

EXPERIMENT 2

Instead of the ceramic nozzle of Experiment 1 having the reinforcing plate bonded to the impact-receiving surface of the nozzle, a nozzle fabricated using a reinforcing plate bonded to the impact-receiving surface of a hard porcelain was attached to the drill bit, and a ground formation similar to that mentioned in Experiment 1 was drilled in the same manner; the drilled depth was 205 m. The nozzle portion was detached from the drill bit and examined, revealing that the inventive nozzle was free of abnormalities, whereas the entrance to the carbide nozzle (comparative example 1) exhibited abrasion and cracks, formed by mud particles, on its inner surface.

The ceramic nozzles described above were provided solely with the reinforcing metal plate which was bonded to the impact-receiving surface. To determine the resistance to impact sustained by dropping a nozzle, a third experiment was conducted.

EXPERIMENT 3

The inventive ceramic nozzle, having solely the high-impact plate bonded to its impact-receiving surface, and devoid of a protective metal ring bonded to its exterior, was dropped from a height of 1.5 m. It was found that the thin-wall portions of the nozzle broke on certain occasions. Another ceramic nozzle in accordance with the invention was prepared, the nozzle having the high-impact plate bonded to its impact-receiving surface, and a protective metal ring fitted over and bonded to its exterior. The nozzle was dropped from a height of 10 m. It was found that the thin-wall portions of the nozzle neither broke nor cracked and in fact, that they exhibited no abnormality whatsoever.

In the drilling and widening of oil wells according to the embodiments described above, water discharge performance is enhanced owing to the smooth interior of the nozzle, and damage to the nozzle can be prevented by bonding the high-impact plate to the bottom surface thereof, which is the portion that receives the greatest impact during use. It was demonstrated that the nozzle is protected against damage when mounting it in the water discharge passage of the drill bit body, or even when it is accidentally dropped on the ground or onto the workshop floor. The inventive nozzle invites maximum oil well drilling and enlarging performance and affords ideal drill bits that exhibit a high degree of durability.

As many apparently widely different embodiments of the present invention can be made without departing from the spirit and scope thereof, it is to be understood that the invention is not limited to the specific embodiments thereof except as defined in the appended claims.

What is claimed is:

1. A complex nozzle for a drill bit and bore enlarging bit of the type having a plurality of rotary cutters provided at the lower end of the bit body, which composite nozzle comprises:

a ceramic member in the shape of a water discharge nozzle provided above the rotary cutters; said ceramic member having a mouth, a circumferential wall surrounding said mouth and a bottom surface, said mouth opening through said bottom surface;

a reinforcing metal ring fitted around the circumferential wall of said ceramic member to prevent damage thereto; and a reinforcing metal plate having a central aperture overlying said mouth, bonded to said bottom surface so as to completely overlay said bottom surface to provide said ceramic member with impact resistance.

* * * * *